United States Patent [19]

Khaidurov et al.

[11] 3,979,997

[45] Sept. 14, 1976

[54] FIREARM HAVING A SLIDE DAMPER AND ENERGY ABSORBER

[76] Inventors: Efim Leontievich Khaidurov, ulitsa Glagoleva, 25, korpus 2, kv. 138, Moscow; Vladimir Alexandrovich Razorenov, ulitsa Ponomareva, 4-a, kv. 51, Minsk, both of U.S.S.R.

[22] Filed: Sept. 27, 1974

[21] Appl. No.: 510,018

[52] U.S. Cl. ..... 89/198

[51] Int. Cl.[2] ..... F41D 11/12

[58] Field of Search ..... 89/196, 198

[56] References Cited

UNITED STATES PATENTS 3,696,706 10/1972 Seidel et al. ..... 89/198

*Primary Examiner*—Stephen C. Bentley

*Attorney, Agent, or Firm*—Haseltine, Lake & Waters

[57] ABSTRACT

A firearm wherein a damper spring is positioned intermediate of a housing and a slide, associated with a return spring for the slide, one end of the damper spring bearing against the housing and the other end cooperating with the slide through an intermediate part. This part is maintained in permanent resilient contact with the housing in a direction transverse to that of the motion of the slide, and is movable relative to the housing jointly with the slide.

3 Claims, 7 Drawing Figures

FIREARM HAVING A SLIDE DAMPER AND ENERGY ABSORBER

The present invention relates to firearms.

It is most expedient to employ the present invention in the construction of self-loading match pistols.

There are known match pistols including a housing supporting therein a barrel. The bore of this barrel is locked with a slide mounted on the housing for reciprocating motion. The housing has also mounted thereon a sighting device and a firing and trigger mechanism cooperating with the slide in the course of a firing cycle. The housing supports at the upper portion thereof a return mechanism returning the slide into the initial position of the latter after a cartridge has been fired. This return mechanism includes a return spring received about a rod having one end thereof bearing against the housing, whereas the opposite end of this rod movably receives thereon a coupling sleeve connected to the housing.

Extending parallel with this rod receiving the return spring thereabout, at both sides of this rod, are damper springs. Each damper spring has one end thereof bearing against the housing, while the opposite end thereof bears against a plunger cooperating with the slide during the recoil motion of the latter.

In this known pistol, after a cartridge has been fired, the recoiling slide first compresses the return spring and then compresses the damper springs, whereby a portion of the recoil energy is gradually accumulated by the contracting return and damper springs, while the remaining portion of the recoil energy is transmitted to the housing and causes jerking of the pistol during firing.

As the slide returns into its initial position, the damper springs accelerate this return motion of the slide with that portion of the recoil energy which has been accumulated by these damper springs. This, in its turn, also results in jerking of the pistol after firing a cartridge and, consequently, hampers the ability of the sportsman to fire the next shot with required accuracy.

It is an object of the present invention to provide a firearm wherein the cooperation of the damper spring and the slide is effected in a manner providing for the reduction of the amount of jerking of the pistol after a shot has been fired.

This and other objects are attained in a firearm wherein, intermediate of the housing and the slide associated with the return spring, there is positioned a damper spring having one end thereof bearing against the housing and having the other end thereof arranged for cooperation with the slide in the course of a firing cycle. In accordance with the present invention, the cooperation of the slide with the damper spring is effected through an intermediate part being urged into permanent resilient contact with the housing in a direction transverse to the direction of the motion of the slide at firing, whereby in the course of firing, a portion of the recoil energy of the slide is absorbed, while in the course of return or counterrecoil of the slide, the energy accumulated by the damper spring is partly absorbed.

It is recommended that the permanent resilient contact of the intermediate part and the housing is through a block urged toward this part by a leaf spring mounted on the housing so that the urging effort is adjustable.

This manner of effecting the resilient contact of the intermediate part and the housing is structurally simple and dependable in service.

It is further advisable that the portion of the housing to which the intermediate part is urged into permanent resilient contact be a separate part of this housing, resiliently biased in the direction of the motion of the slide, and that this separate part be connected with the housing in a manner providing for movement of this part jointly with the slide in the course of firing.

The above arrangement has been found to reduce still further the amount of jerking of the housing at firing.

A firearm constructed in accordance with the present invention offers maximum stability at firing, owing to the gradual absorption of a substantial portion of the energy of recoil of the slide, which is of paramount importance at match firing at silhouette targets.

The above objects and advantages of the present invention will be made apparent in the following description of preferred, exemplary embodiments of the invention, reference being had to the accompanying drawings, wherein.

Figure 1:
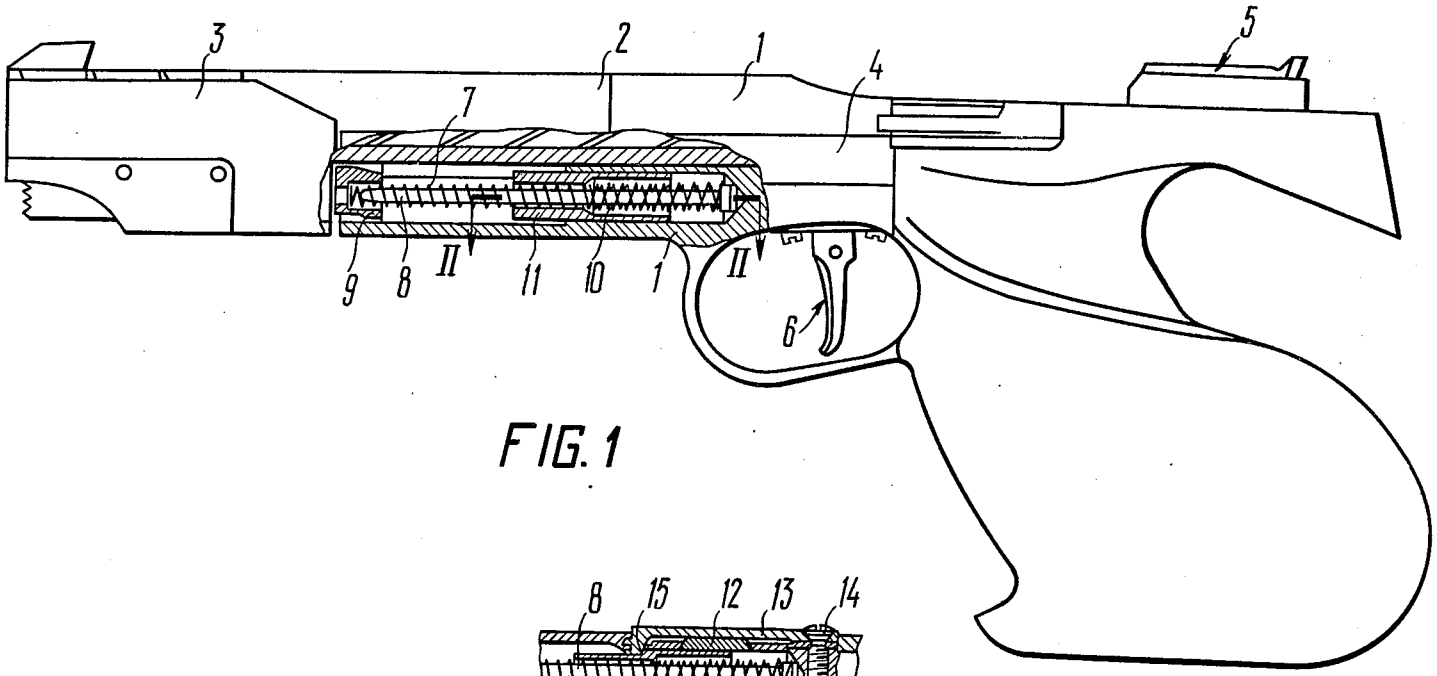
FIG. 1 is a general, partly broken away view of a self-loading match pistol constructed in accordance with the invention.
Figure 2:
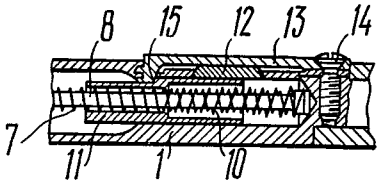
FIG. 2 is a sectional view on line II — II in FIG. I.
Figure 3:
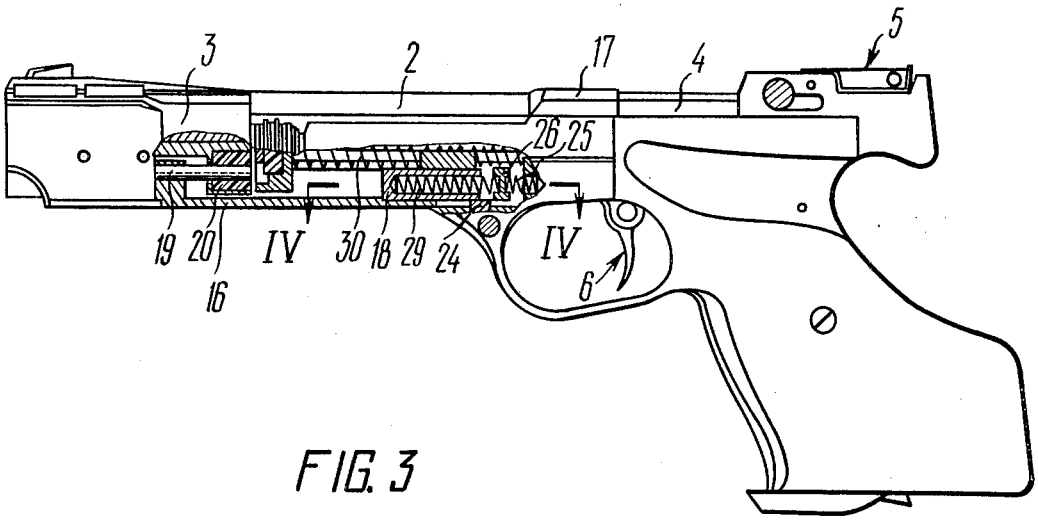
FIG. 3 is an alternative embodiment of a self-loading match pistol in accordance with the invention.
Figure 4:
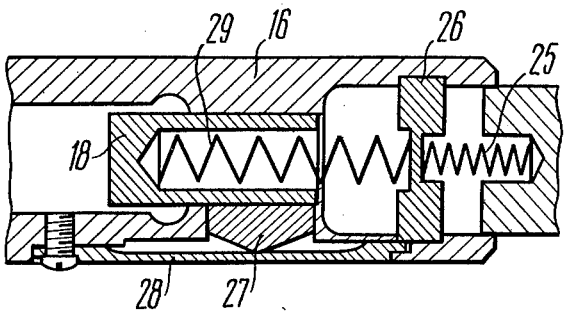
FIG. 4 is a sectional view on line IV—IV in FIG. 3, an enlarged view.
Figure 5:
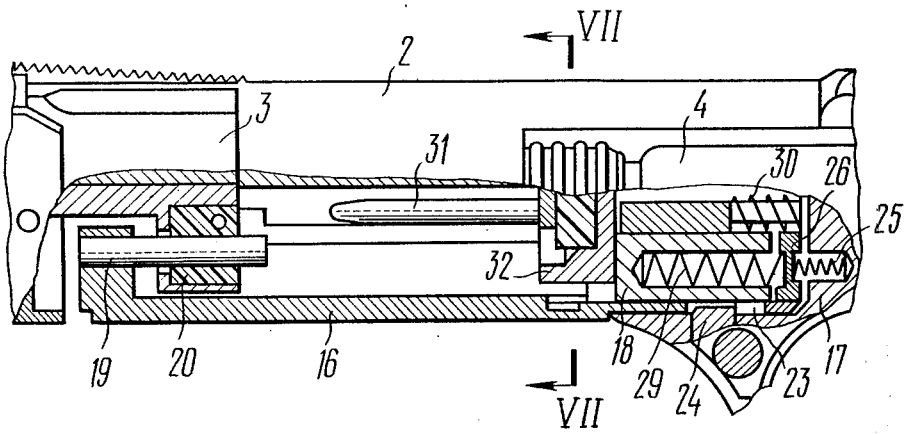
FIG. 5 is a partly broken away view illustrating relative positions of the slide, intermediate part, damper spring and movable part of the housing, the said parts being at their rearmost positions.
Figure 7:
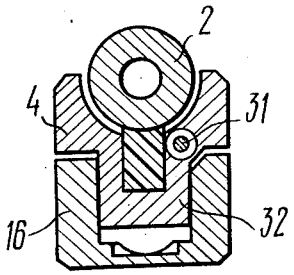
FIG. 7 is a sectional view on line VII—VII in FIG. 5.
Figure 6:
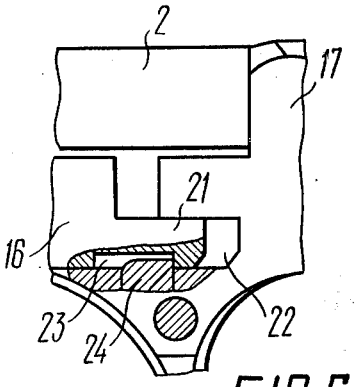
FIG. 6 illustrates connection of the movable part with the housing.

Referring now in particular to the appended drawings, and particularly to FIGS. 1, 2 thereof, the self-loading match pistol comprises a housing 1 (FIG. 1) having mounted thereon the barrel 2 with the compensator 3. The housing 1 has also mounted thereon a slide 4 locking a bore of the barrel 2, a sighting device 5 and a firing and trigger mechanism 6. Underlying the barrel 2 at the bottom portion of the housing 1 is a return spring 7 received about a guide rod 8 so that one end thereof bears against the head of this rod, received in the housing, while the opposite end of this return spring 7 bears against a depending lug 9 of the slide 4 extending downwardly from the foremost portion of the slide 4.

The lug 9 of the slide has made therethrough a stepped-diameter bore through which the guide rod 8 passes, as the slide 4 moves toward its rearmost position. The guide rod further receives thereabout a damper spring 10 coaxial with the return spring 7.

Received about the same guide rod 8, intermediate of the lug 9 of the slide 4 and the damper spring 10, is an intermediate part 11 in the form of a sleeve with a stepped-diameter through bore adapted for passage therethrough of the return spring 7 and of the rod 8. The damper spring 10 has one end thereof bearing against the housing 1 and the other end thereof bearing against the intermediate part 11. The intermediate part 11 is urged into permanent resilient contact with the housing 1 in a direction transverse to that of the reciprocating motion of the slide 4, this part 11 being movable relative to the housing 1 jointly with the slide 4.

To effect this resilient contact of the intermediate part 11 with the housing 1 the latter has a groove made in the right-hand (relative to the aiming line) portion thereof, this groove receiving therein a block 12 (FIG. 2). The block 12 is urged to the intermediate part 11 by a leaf spring 13 of which one end is secured to the housing and the other end is clamped to the housing 1 by a screw 14, whereby the urging effort exerted by this spring upon the block 12 is adjustable by rotation of this screw 14.

To limit the motion of the intermediate part 11 under the action of the damper spring 10, i.e. at the return or counterrecoil motion of the slide 4 (FIG. 1), the foremost (in the drawing) end of the leaf spring 13 (FIG. 2) is provided with a depending lug 15 against which the intermediate part 11 abuts in the foremost position thereof.

The incorporation of the intermediate part 11, of the block 12 and of the leaf spring 13 results in a gradual absorption of the recoil energy of the slide at firing since the latter, while moving toward its rearmost position, first compresses its return spring 7 and then moves jointly with the braked intermediate part 11, compressing the damper spring 10.

The joint operation of the three abovementioned members in the course of braking of the slide 4 (FIG. 1), i.e. in the course of absorption of its recoil energy, has been found to prolong the braking time and to reduce jerking of the pistol at firing.

To promote still further the stability of the pistol at firing, FIGS. 3 to 7 show an alternative embodiment wherein a part 16 (FIGS. 3, 4, 5) of a modified housing 17, with which an alternative intermediate part 18 is urged into permanent resilient contact, is made as a part separate of the housing 17. This part 16, which will be hereinafter referred to as the separate member 16, is arranged for axial reciprocation relative to the housing 17. The foremost (in the drawing) portion of the member 16 has a pin 19 secured therein by pressure fit, while the compensator 3, rigidly secured to the barrel 2, has made therein a bore into which a fluoroplastic bush 20 is inserted, also by pressure fit. The pin 19 is reciprocable in the bore of this bush 20. The rear end of the member 16 is movably connected with the housing by means of lateral projections 21 (FIG. 6) provided on the member 16 and received in corresponding grooves 22 made in the housing 17.

The bottom of the member 16 has made therein a notch 23 adapted to receive therein a latch 24 provided for limiting the motion of the member 16. The latch is mounted on the housing 17 and may be of any known structure suitable for the purpose.

The member 16 is resiliently urged in the direction of reciprocation of the slide 4 by a spring 25 (FIGS. 3, 4, 5) having one end thereof bearing against the housing 17 and the other end thereof bearing against a partition 26 secured in the member 16.

The member 16 has the intermediate part 18 mounted therein and urged thereto by a block 27 (FIG. 4) and a leaf spring 28. The intermediate part 18 is shaped as a sleeve with a blind end. In the presently described embodiment a damper spring 29 is retained between the partition 26 and the blind end of the internal bore of the intermediate part 18.

A return spring 30 (FIG. 3) is received about a guide rod 31 (FIGS. 3, 5, 7) of which one end is secured to the housing 17 above the member 16, while the opposite end of the rod 31 passes through a lug 32 depending from the slide 4 at the foremost end of the latter.

Although the above disclosure of the slide damping arrangement is related to a match pistol, it is quite obvious that a similar arrangement can be incorporated in any other kind of self-loading and automatic firearm.

The herein disclosed self-loading match pistol operates, as follows. After a cartridge has been fired, the slide 4 recoils rearwardly and compresses the return spring 7, its lug 9 acting upon the foremost (in the drawings) end of the intermediate part 11. The last-mentioned part is thus displaced relative to the housing 1 jointly with the slide 4 toward its rearmost position, overcoming the force of friction caused by the effort of the block 12 and the loading of the damper spring 10.

Thereafter the slide 4 is moved through its return or counter-recoil motion toward its foremost position by the action of the return spring 7 and the damper spring 10. However, the damper spring 10 applies to the slide 4 but a portion of the energy it has stored at its compression. The remaining portion of this energy is spent on overcoming the force of friction between the block 12 and the intermediate part 11.

Consequently, the speed of the slide 4, as the latter hits the housing 1 as it is brought into its foremost position, is lower than that in hitherto known match pistols, owing to the incorporation of the intermediate part 11 and of the block 12, with the jerking of the pistol being reduced accordingly.

A self-loading match pistol described hereinabove as the second embodiment of the present invention operates as follows. After a cartridge has been fired, the slide 4 recoils rearwardly and compresses the return spring 30, its lug 32 acting upon the foremost end of the intermediate part 18. The latter is thus moved relative to the member 16 jointly with the slide 4 toward its rearmost (in the drawings) position, overcoming the friction between itself and the block 27 and loading the damper spring 29, in which way a portion of the energy of the slide recoil is absorbed. The member 16 which was resting at the moment of impact of the slide 4 upon the intermediate part 18 is displaced rearwardly (in the drawings) under the action of the contracting damper spring 29, and the force of friction between the block 27 and the intermediate member 18, this displacement compressing the spring 25 associated with the member 16.

Thus, the major portion of the energy of recoil of the slide 4 is absorbed by the return spring 30, by the damper spring 29, by the friction between the intermediate part 18 and the block 27, and is partly transformed into the energy of the motion of the member 16, which further relieves the housing 17 from the direct action thereupon of the recoiling slide 4, whereby jerking of the pistol, caused by firing the shot is reduced. From its rearmost position the slide 4 is returned into its foremost position by the action of the return spring 30.

The spring 25 returns the member 16 into the foremost position of the latter with respect to the housing 17, while the damper spring 29 moves the intermediate part 18 into the foremost position with respect to the member 16, spending the energy it has stored on overcoming the friction between the block 27 and the intermediate part 18. In this way all the abovementioned movable parts resume the position illustrated in FIG. 3, i.e., the pistol is prepared for firing a successive shot.

What we claim is:

1. A firearm comprising: a housing; a barrel supported by said housing and having a bore therethrough; a compensator forwardly of said barrel; a slide for locking said bore, mounted on said housing for reciprocation at the firing of the firearm; a firing and trigger mechanism mounted on said housing; a return spring disposed underneath and substantially parallel with said barrel, at the bottom portion of said housing, having one end thereof bearing against said housing, just behind said compensator, and the other end against said slide; a damper spring having one end thereof bearing against said housing and the other end arranged for cooperation with said slide at the firing; a part arranged intermediate of said slide and said damper spring so that the cooperation of said slide and said damper spring is effected through said intermediate part; and means for biasing said intermediate part into permanent resilient contact with a portion of said housing in a direction transverse to the direction of the reciprocation of said slide; said intermediate part being movable relative to said housing jointly with said slide, whereby part of the recoil energy of said slide is absorbed after the firing, and then part of the energy stored by said damper spring is absorbed when said slide performs its return motion.

2. The firearm as defined in claim 4, wherein said portion of the housing with which said intermediate part is biased into contact is a separate part of said housing, resiliently urged in the direction of the reciprocation of said slide, and associated with said housing so that said separate part can perform the movement relative to said housing jointly with said slide at the firing of the firearm.

3. A firearm comprising: a housing; a barrel supported by said housing; a slide for locking said bore, mounted on said housing for reciprocation at the firing of the firearm; a firing and trigger mechanism mounted on said housing; a return spring having one end thereof bearing against said housing and the other end against said slide; a damper spring having one end thereof bearing against said housing and the other end arranged for cooperation with said slide at the firing; a part arranged intermediate of said slide and said damper spring so that the cooperation of said slide and said damper spring is effected through said intermediate part; and means for biasing said intermediate part into permanent resilient contact with a portion of said housing in a direction transverse to the direction of the reciprocation of said slide; said intermediate part being movable relative to said housing jointly with said slide, whereby part of the recoil energy of said slide is absorbed after the firing, and then part of the energy stored by said damper spring is absorbed, wherein said biasing means include a block biased toward said intermediate part by a leaf spring mounted in said housing, with means providing adjustment of the biasing by said leaf spring.

* * * * *